US006155092A

United States Patent [19]

Sahlem

[11] Patent Number: 6,155,092

[45] Date of Patent: Dec. 5, 2000

[54] APPARATUS AND METHOD FOR FORMING A DOUBLE ENDED UPSET PIPE

[75] Inventor: Donald P. Sahlem, Akron, N.Y.

[73] Assignee: Wyman-Gordon Company, North Grafton, Mass.

[21] Appl. No.: 09/414,026

[22] Filed: Oct. 7, 1999

Related U.S. Application Data

[60] Provisional application No. 60/103,798, Oct. 9, 1998.

[51] Int. Cl.[7] ..... B21C 25/08

[52] U.S. Cl. ..... 72/260; 72/264; 72/266; 72/370.01; 72/370.14; 72/370.23

[58] Field of Search ..... 72/260, 264, 266, 72/370.01, 370.03, 370.06, 370.07, 370.1, 370.14, 370.23, 370.24

[56] References Cited

U.S. PATENT DOCUMENTS

| | | | |
|---|---|---|---|
| 2,391,766 | 12/1945 | Barnhart . | |
| 2,778,493 | 1/1957 | Kreidler . | |
| 3,096,579 | 7/1963 | Waller . | |
| 3,176,494 | 4/1965 | Cullen et al. . | |
| 3,950,979 | 4/1976 | Fuchs, Jr. . | |
| 4,206,626 | 6/1980 | Groos et al. . | |
| 4,292,831 | 10/1981 | Simon . | |
| 5,522,246 | 6/1996 | Simon | 72/260 |
| 5,533,375 | 7/1996 | Chen et al. . | |

FOREIGN PATENT DOCUMENTS

| | | | |
|---|---|---|---|
| 0 384 641 | 8/1990 | European Pat. Off. . | |
| 926 482 | 4/1955 | Germany . | |
| 39-832 | 1/1964 | Japan | 72/260 |
| 643857 | 9/1950 | United Kingdom . | |
| 738762 | 10/1955 | United Kingdom | 72/260 |
| 890012 | 2/1962 | United Kingdom | 72/260 |

OTHER PUBLICATIONS

IPEA/EP PCT International Search Report—Appl. No. PCT/US99/23618, Mailed Feb. 15, 2000.

*Primary Examiner*—Ed Tolan
*Attorney, Agent, or Firm*—Blodgett & Blodgett, P.C.

[57] ABSTRACT

Apparatus for and method of extruding a metal pipe having a uniform inner diameter, and forward and rearward end sections which are thicker than the middle section of the pipe. A metal billet having a bore is inserted into an open ended cylindrical bore of a stationary container. The billet is moved axially within the bore of the container by a press which includes a pressing surface and a mandrel extending forwardly from the pressing surface through the bore of toward the billet. The mandrel has a cylindrical large diameter rearward portion, a cylindrical small diameter middle portion and a forwardly and outwardly tapering forward portion. Metal from the billet is forced through the small diameter bore of a two part removable first die around the middle portion of the mandrel by moving the press forwardly for a first distance to form a preliminary forward end section of pipe. The press is moved forwardly for a second distance for forcing metal from the billet through the bore of the first die around the rearward portion of the mandrel for extruding the middle section of pipe and causing the preliminary forward end section of pipe to pass over the tapered forward portion of the mandrel to form the forward end section of pipe. The press is moved forwardly for a third distance for forcing metal from the billet through the relatively large bore of a second die around the rearward portion of the mandrel to form the rearward end section of pipe.

33 Claims, 13 Drawing Sheets

APPARATUS AND METHOD FOR FORMING A DOUBLE ENDED UPSET PIPE

CROSS-REFERENCE TO RELATED APPLICATIONS

This application claims the benefit under 35 U.S.C. §119 (e) of prior U.S. Provisional Application No. 60/103,798 filed Oct. 9, 1998; all of which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed to an apparatus for forming a fluid conveying pipe known in the trade as a "double ended upset pipe". Such a pipe has a forward, or "pin" end section, an elongated middle section and a rearward, or "box" end section. The inner diameters of all three sections of the pipe are the same. The outer diameters of the forward and rearward end sections of the pipe are substantially greater than the outer diameter of the middle section of pipe. Therefore, the thickness of the middle section of the pipe is substantially thinner than either of the forward and rearward end sections of the pipe. The extra thickness of the forward and rearward end section of the pipe is machined and/or threaded to enable the forward, or "pin" end of a first pipe to be coupled to the rearward or "box" end of a second pipe.

In the past, metallic double ended upset pipes have been formed by extruding the middle and end sections of the pipe separately and welding the forward and rearward end sections to opposite ends of the middle section. Since the welded areas represent potentially weak areas of the pipe, each section of the pipe is made thicker than that which would normally be needed. This procedure is time consuming and expensive. The extra thickness which requires extra material also adds a material cost to the pipe. The added weight of the pipe adds still further costs in shipping and handling.

Many metal extrusion devices and methods have been developed for extruding a pipe from a billet with the use of a press, a die, and a mandrel. However, there is no known apparatus or system for extruding an integral pipe having a uniform inside diameter in which the opposite end sections of the pipe have an outside diameter greater than the outside diameter of the middle section of the pipe. These and other difficulties experienced with the prior art pipe extruding devices or methods have been obviated by the present invention.

It is, therefore, a principal object of the invention to provide an apparatus for extruding a pipe from a metal billet for producing an integrally formed pipe having a constant or uniform inside diameter and a middle section which has a smaller outside diameter than the outside diameter of each of the opposite end section of the pipe.

A further object of the invention is the provision of an apparatus for extruding a pipe from a metal billet as described above in a single continuous extrusion operation.

Another object of the present invention is the provision of a method of extruding a pipe from a metal billet in which the pipe has uniform inside diameter and a middle section having a smaller outside diameter than the outside diameter of the opposite end sections of the pipe.

A still further object of the invention is the provision of a method of extruding from a metal billet a pipe as defined above in a single continuous process.

Still another object of the invention is the provision of having an outside non-uniform configuration mandrel for use in a metal extrusion machine for extruding from a metal billet a pipe having a uniform inside diameter and a middle section which has a smaller outside diameter than the outside diameter of the opposite end sections of the pipe.

Another object of the invention is the provision of an apparatus for extruding a pipe from a metal billet wherein the middle section of the pipe has a smaller outside diameter than the outside diameter of each of the opposite end sections of the pipe and one end section of the pipe has a smaller inner diameter that the inner diameter of the middle section and opposite end section of the pipe.

With these and other objects in view, as will be apparent to those skilled in the art, the invention resides in the combination of parts set forth in the specification and covered by the claims appended hereto.

BRIEF SUMMARY OF THE INVENTION

Apparatus for and method of extruding a metal pipe having a substantially uniform inner diameter. The forward and rearward end sections of the pipe are thicker than the middle section of the pipe. A heated metal billet having a cylindrical longitudinal bore is inserted into the rear opening of a cylindrical bore of a stationary container. A two-part removable inner die is located within the bore of the container adjacent the forward end of the container and an outer die is located outside of the container adjacent the front end of the container. The inner die has a relatively small diameter cylindrical bore. The outer die has a relatively large diameter cylindrical bore. The billet is moved along a central longitudinal axis within the bore of the container by a press which includes a circular forward pressing surface and a mandrel extending forwardly from the pressing surface toward the billet. The mandrel has a cylindrical relatively large diameter rearward portion, a cylindrical relatively small diameter middle portion and a frusto conical forward portion which tapers outwardly in the forward direction from the diameter of the middle portion to the diameter of the forward portion. Metal from the billet is forced through the bore of the inner die around the small diameter portion of the mandrel by moving the press forwardly for a first distance for extruding a preliminary forward end section of pipe. The press is moved forwardly for a second distance for forcing metal from the billet through the bore of the inner die around the large diameter rearward portion of the mandrel for extruding the middle section of pipe and causing the preliminary forward end section of pipe to pass over the tapered forward portion of the mandrel. This causes the preliminary forward end section of pipe to be expanded transversely of its central longitudinal axis to an inner diameter which is equal to the inner diameter of the middle section and a wall thickness which is greater than the wall thickness of the middle section of pipe. The inner die is removed from the container and the press is moved forwardly for a third distance for forcing metal from the billet through the bore of the outer die around the rearward portion of the mandrel to extrude the rearward end section of pipe having an inner diameter which is equal to the inner diameter of the middle section of pipe and a wall thickness which is greater than the wall thickness of the middle section of pipe.

BRIEF DESCRIPTION OF THE DRAWINGS

The character of the invention, however, may be best understood by reference to one of its structural forms, as illustrated by the accompanied drawings, in which.

DETAILED DESCRIPTION OF THE INVENTION

Figure 1:
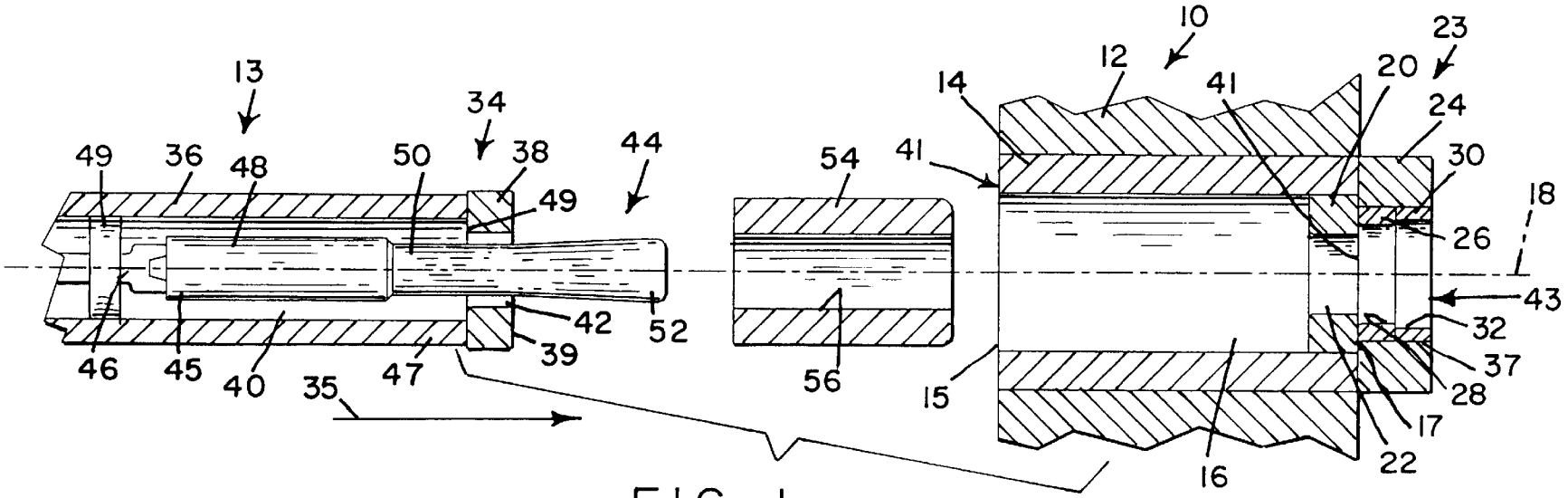
FIG. 1 is a longitudinal cross-sectional view of the primary functional components of the extruding apparatus of the present invention for forming a double ended upset pipe.

Referring first to FIGS. 19*a*, 19*b*, 19*c*, and 19*d*, the pipe extruding apparatus of the present invention is generally indicated by the reference 10. Apparatus 10 comprises a rearward machine base 72, and a forward machine base 72 connected to the rearward machine base by four connecting rods 74. A press, generally indicated by the reference numeral 13, is mounted on the pipe extruding apparatus 10 between the machine bases 70 and 72 for longitudinal movement along central longitudinal axis 18.

Press 13 includes a crosshead 78 located between the machine base 70 and 72. A piston 75 is connected to the rearward side of the crosshead 78 through a horizontal connector 79. Piston 75 is slidably mounted within a single acting hydraulic cylinder 77 which is fixed to the rearward machine base 72. Cylinder 77 is connected to a high pressure hydraulic source, not shown, through hydraulic line 73. Crosshead 78 is supported on a pair of longitudinal ways 81 and guided on the connecting rails 74 for longitudinal forward and rearward movement along the longitudinal axis 18. Crosshead 78 has a horizontal bore 65 which is coaxial with longitudinal axis 18. A double acting hydraulic cylinder 81 is fixed to the hydraulic cylinder 77 through a structural support 82. A piston, generally indicated by the reference numeral 85, includes a piston head 89 slidably mounted within the cylinder 81 and a piston rod 93 extending from the cylinder 81 and fixed to the upper end of the crosshead 78. Cylinder 81 is connected to a high pressure hydraulic source, not shown, through hydraulic lines 76. Actuation of cylinder 77 causes the piston 75 and the crosshead 78 to move forwardly toward the forward machine base 70. The relatively large size of the cylinder 77 provides the large forces required to force a billet through the die structure to be described at the forward end of the extruder. The crosshead 78 and the piston 75 are moved rearwardly to their starting positions by actuating the cylinder 81 so that the head 89 is moved rearwardly within the cylinder 81. Press 13 also includes a cylindrical housing or stem 36 that is fixed to the forward side of crosshead 78 and extends forwardly along the longitudinal axis 18. A double acting hydraulic cylinder 69 is fixed to the rearward side of crosshead 78 and connected to the high pressure hydraulic source through hydraulic lines 68.

Stem 36 has a chamber 40 and a forward end 47 which contains a forward opening 49 to the chamber 40. A pressing ring 38 is located at the forward opening 49 of the housing 36 and contains a cylindrical bore 42 and a circular forward pressing surface 39. A mandrel 44 is located within the chamber 40 and has a rearward end 45 configured to be coupled to the forward end of a driving rod 46. A bushing 59 is fastened to the forward end of the driving rod 46 with a clearance fit within the stem 36. This helps to support the driving rod 46 and maintains the mandrel 44 on center. The rearward end of the driving rod 46 is coupled to a piston 71 which is slidably mounted within the cylinder 69. The cylinder 69 enables the mandrel 44 to be selectively moved forwardly and rearwardly along the longitudinal axis 18 relative to the stem 36. The mandrel 44 is coaxial about the central longitudinal axis 18. The mandrel 44 has a cylindrical rearward portion 48, a reduced diameter cylindrical middle portion 50, and a frusto conical forward portion 52 which tapers outwardly from the reduced diameter middle portion 50 to the forward end of the mandrel. The extreme forward end of the mandrel 44 has the same diameter as that of the rearward portion 48. The mandrel 44 extends freely through the bore 42 of the pressing ring 38. The pressing ring 38 is not attached to the stem 36 and is supported on the mandrel 44.

Figure 3:
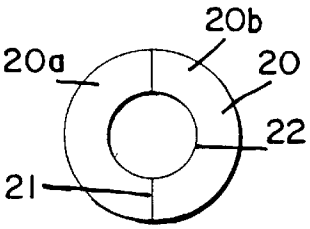
FIG. 3 is an end view of a two-part die which also forms a portion of the apparatus.
Figure 2:
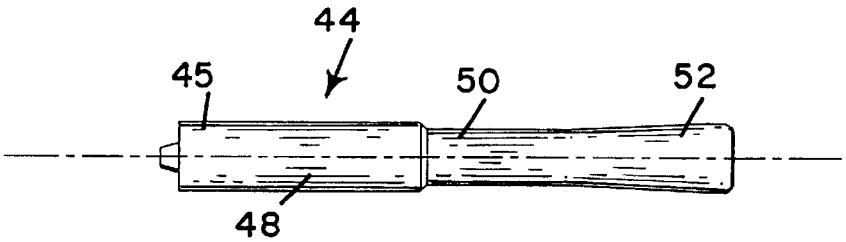
FIG. 2 is a side elevational view of the mandrel portion of the apparatus.

A housing or container 12 is supported on the forward machine base 70. The housing 12 is fixed to a pair of oppositely extruding connecting arms 80. Connecting arms 80 are fixed to the rearwardly extending ends 85 of a pair of pistons, generally indicated by the reference numeral 84. The forward ends of pistons 84 are slidably mounted within double acting hydraulic cylinders 88 which are connected to the high pressure hydraulic source through hydraulic lines 90. The hydraulic cylinders 88 are fixed to the forward machine base 70. The housing 12 contains a cylindrical tube or liner 14 having a circular bore 16 which is coaxial with the longitudinal axis 18. The bore 16 has a circular rear opening 15 and a circular front opening 17. Referring also to FIGS. 1 and 3, a cylindrical inner die 20 is located within the bore 16 adjacent the front opening 17 of the bore. The inner die 20 is divided transversely along the line 21 to form two separable halves 20*a* and 20*b*. An outer die assembly, generally indicated by the reference numeral 23, is located outside of the front opening 17 of the bore 16. The outer die assembly 23 includes a die holder 24 which has a bore 37, a rearward end 41, and a forward end 43. An outer die 26 is located within the bore 37 at the rearward end 41 of the die holder 24. A back plate 30 is located at the forward end 43 of the die holder 24. The outer die 26 has a circular bore 28. The back plate 30 has a circular bore 32. The diameter of the bore 32 is slightly larger than the diameter of the bore 28. The bore 22 of the inner die 20 has a smaller diameter than the diameter of the bore 28.

The pipe which is to be formed by the extruding apparatus 10 of the present invention is formed from a cylindrical billet 54 that has a cylindrical longitudinal bore 56. The size of the billet 54 is such that there is a specified amount of clearance between the outer surface of the billet relative to the inner surface of the liner 14 which defines the bore 16. The diameter of the bore 56 of billet 54 has a specified clearance relative to the outer diameter of the portions 48 and 52 of the mandrel. The stem 36 of the press 13 moves along the axis 18 and applies all of the forward force of the press 13 to the billet 54.

The outer die assembly 23 is located within a retaining ring 92 which is located at the rearward end of a removable housing or outer die carrier 98. Die carrier 98 is located within a horizontal chamber 100 in the forward machine base 70. Chamber 100 has a rear opening 103 and a forward opening 99. Carrier 98 has a central horizontal bore 97 that has a forward opening 86 and a rearward opening 87. The rearward portion of the bore 97 has a counterbore 96 which contains the retaining ring 92 and outer die assembly 23. A retaining plate 94 is located at the forward end of the counterbore portion of the bore 97. Retaining plate 94 has a bore 91 which has a larger diameter than the bore 32 of the back plate 30.

Figure 19A:
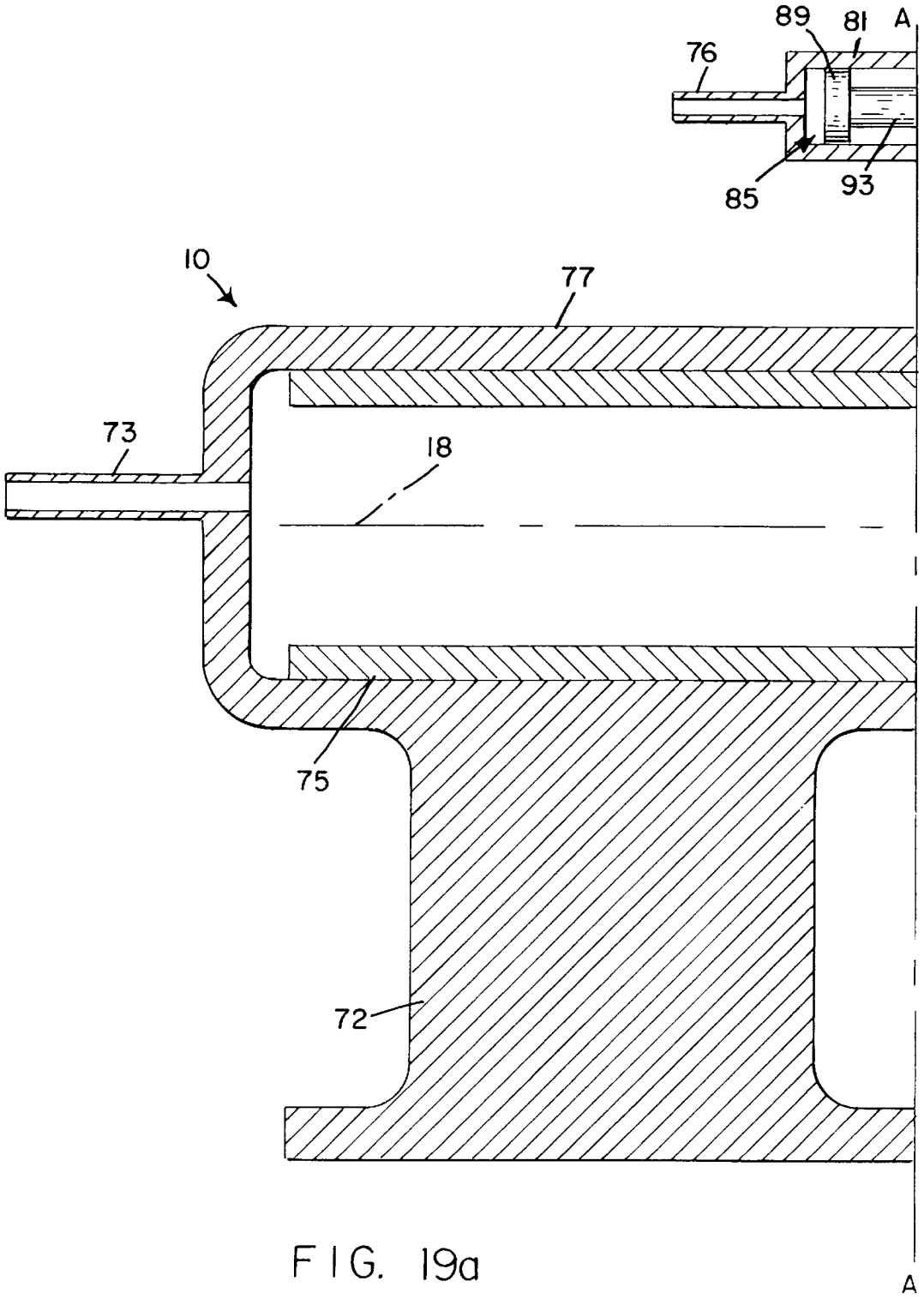
FIGS. 19*a*, 19*b*, 19*c*, and 19*d* are vertical cross-sectional views which may be joined together along the common lines A—A, B—B, and C—C and showing the overall extruding apparatus of the present invention.
Figure 19B:
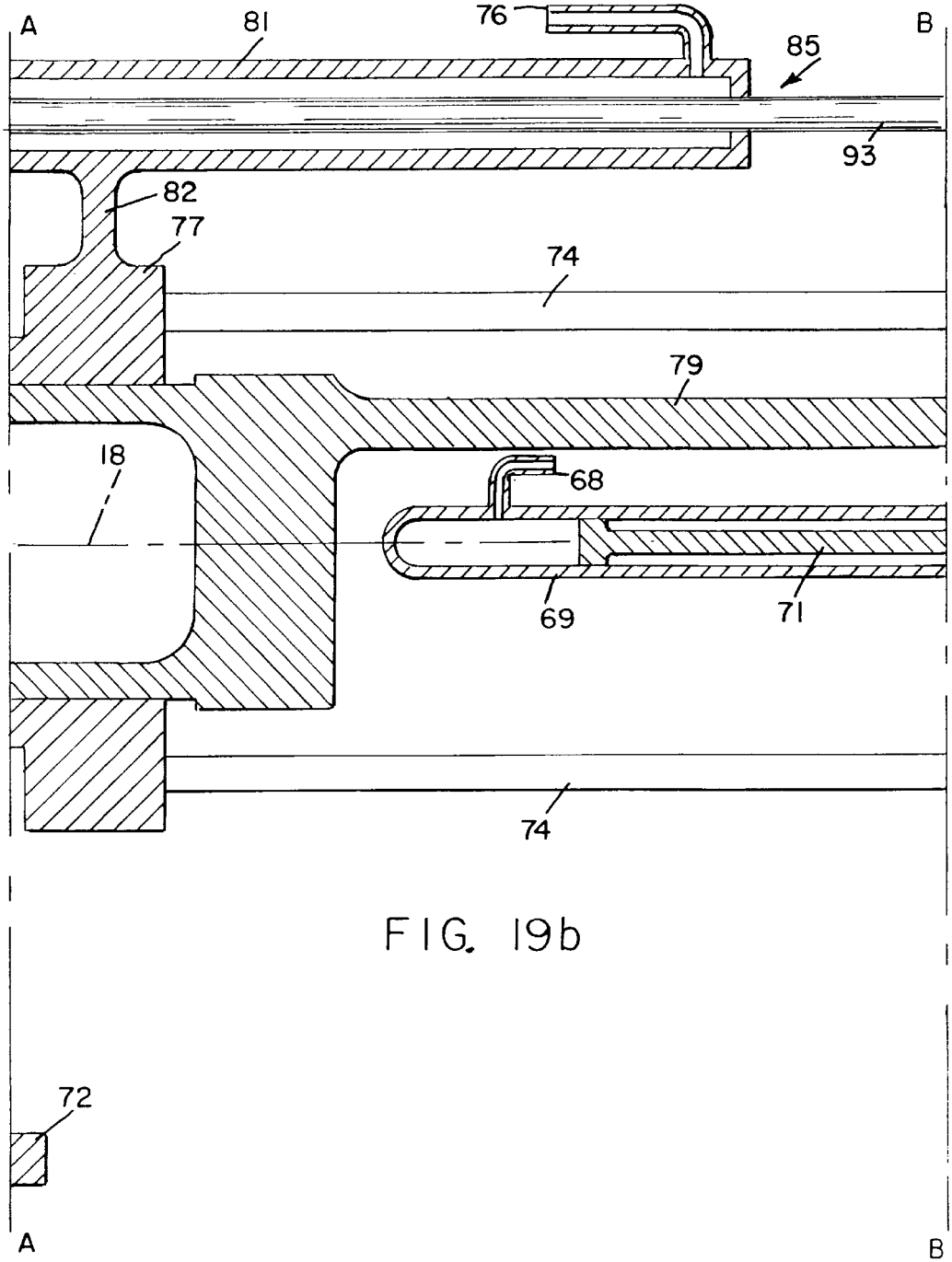
Figure 19C:
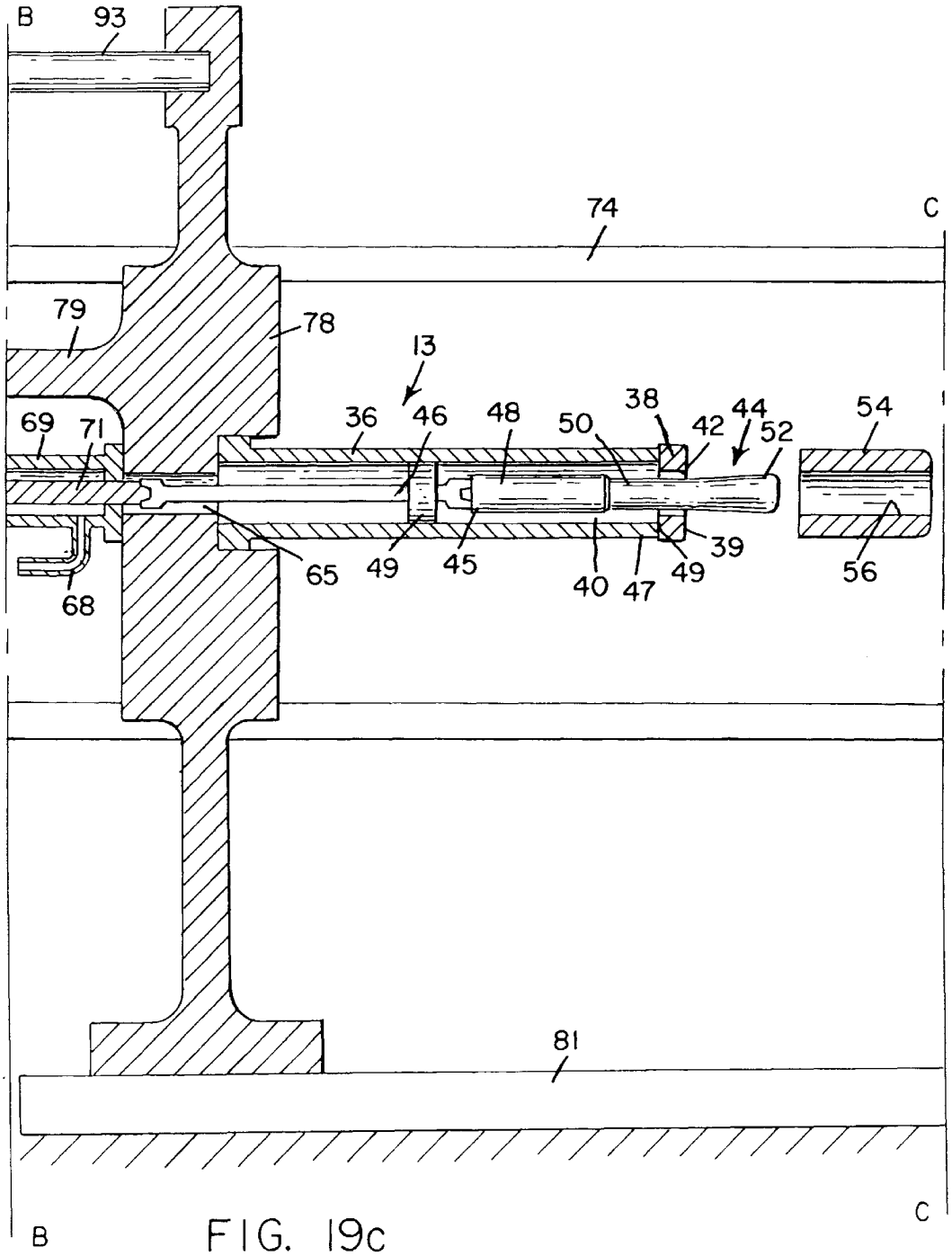
Figure 19D:
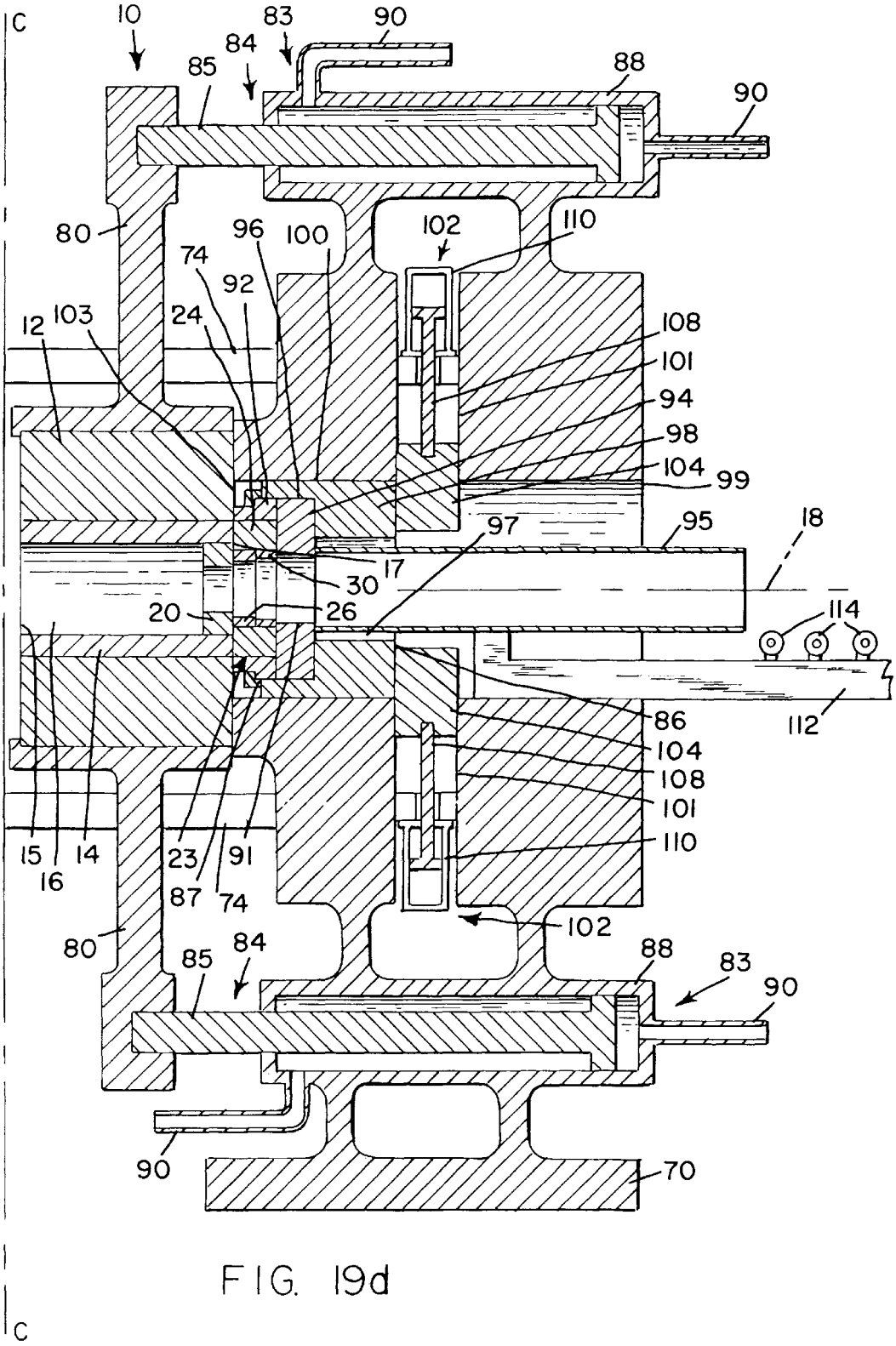

The outer die carrier 98 is maintained at the rearward end of the chamber 100 by a releasable stop mechanism, generally indicated by the reference numeral 102. Stop mechanism 102 includes a pair of oppositely facing gates 104 slidably mounted within transverse bores 101 which intersect the chamber 100. Each gate 104 is connected to one end of a piston 108. The opposite end of each piston 108 is slidably mounted within a hydraulic cylinder 110. Each hydraulic cylinder 110 is fixed to the forward machine base 70. the 10 hydraulic cylinders 110 can be controlled for selectively moving the gates 104 between an active position, as shown in FIG. 19*d*, in which the gates 104 are located within the chamber 100 to an inactive position in which the gates 104 are outside of the chamber 100. When the gates 104 are in their active positions, they block any forward movement of the outer die carrier 98 and maintain the outer die assembly 23 against the forward end of the container 12 and the inner die 20. When the gates 104 are in their inactive positions, the outer die carrier 98 can be removed from the chamber 100 through the front opening 99.

A guide tube 95 is fixed to the forward side of the retaining plate 94. Guide tube 45 is coaxial with the longitudinal axis 18 and extends forwardly through the front opening 99. A table 112 is fixed to the guide tube 95 and extends below the tube 95. A plurality of guide rollers 114 are located on the upper surface of the table 112.

Having described the details of the pipe forming apparatus of the present invention, a double ended upset pipe blank is formed in accordance with the following description.

Figure 4:
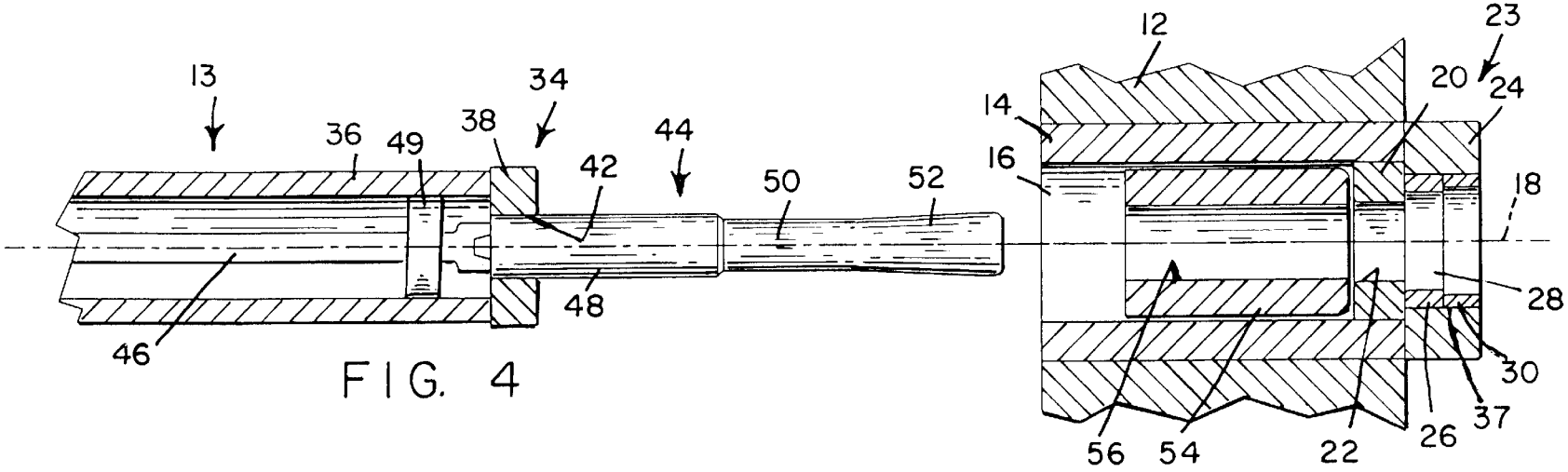
FIGS. 4–12 are operational views illustrating the formation of the forward and middle sections of the pipe.
Figure 5:
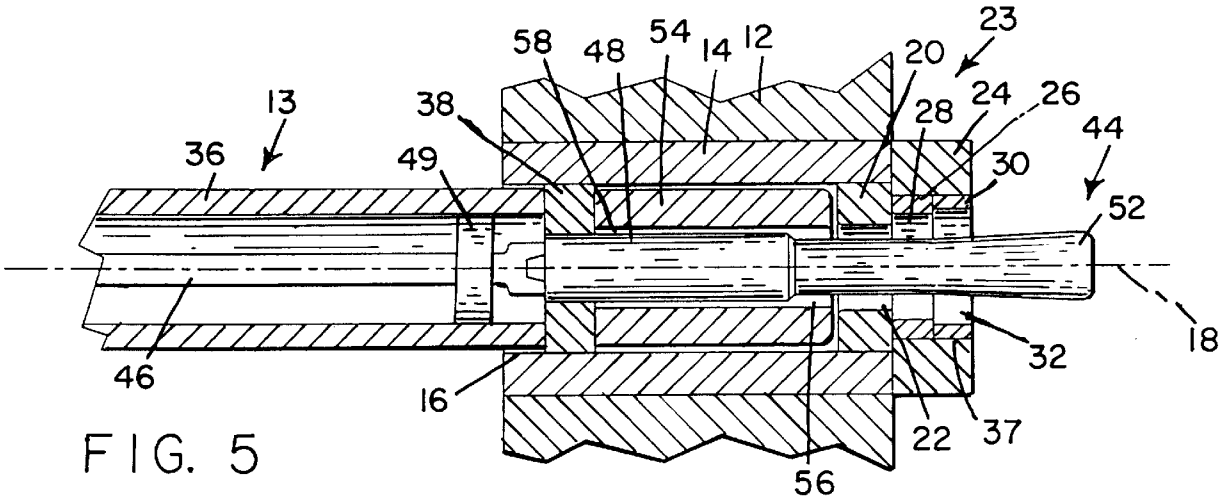

Referring to FIG. 1, the mandrel 44 is shown retracted into the stem 36 to enable the billet 54 to be positioned between the mandrel 44 and the opening 15 of the chamber 16. The billet 54 is then loaded into the bore 16 of the container 12. Once the billet 54 has been loaded into the bore 16, as shown in FIG. 4, the cylinder 69 is actuated to force the driver 46 forwardly relative to the crosshead 78 and stem 36. The mandrel 44 is thereby extended forwardly by the driver 46, relative to the stem 36, so that the rearward portion 48 of the mandrel is at the forward end of the stem 36 and within the bore 42 of the pressing ring 38. At this point, the mandrel 44 is maintained in a fixed position relative to the ring 38. The cylinder 77 is actuated to move the press 13, comprising crosshead 78, stem 36, mandrel 44, and pressing ring 38, forwardly as a single unit. The press 13 is moved forwardly, as shown in FIG. 5, along the longitudinal axis 18 so that the mandrel 44 extends through the bore 56 of the billet 54, through the bore 22 of the inner die 20, through the bore 28 of the outer die 26 and through the bore 32 of the back plate 30. The stem 36 also enters the bore 16, as shown in FIG. 5. The pressing ring 38 is shown in FIG. 5 abutting the rearward end of the billet 54 just prior to applying a forward compressing force to the billet.

A preferred variation of this first step is to actuate cylinder 69 to push the mandrel 44 through the bore 56 of the billet 54 while the billet is supported on a moveable carriage. The cylinder 77 is actuated to move the press 13 toward the container 12, thereby carrying the mandrel 44 and the billet 54 into the bore 16 of the container to the position shown in FIG. 5.

Figure 6:
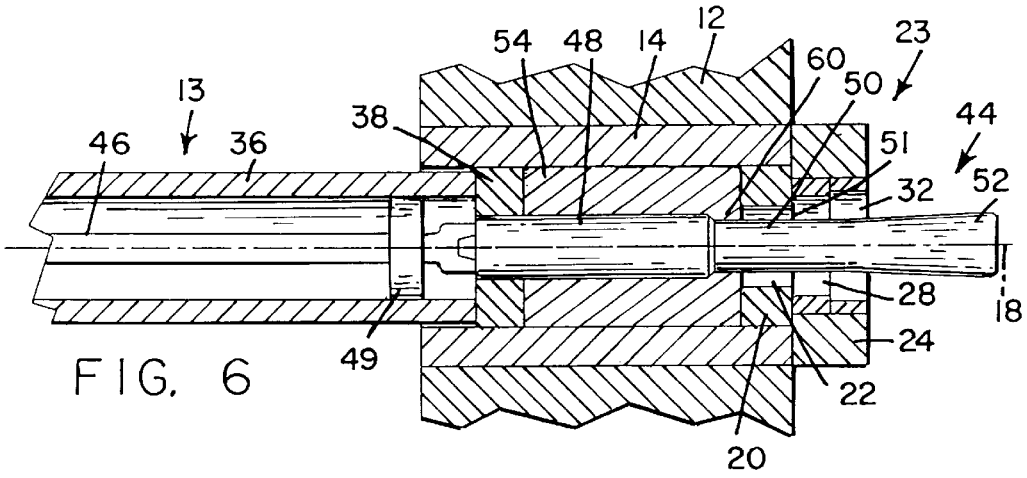

The billet is forced against the rearward end of the inner die 20 by additional forward movement of the press 13. A small forward movement of the press 13 squeezes the billet 54 and forces metal from the billet to completely fill the space between the inner surface of the liner 14 and the billet. Metal at the forward end of the billet 54 is also forced inwardly toward the reduced diameter middle portion 48 of the mandrel 44 as shown in FIG. 6 to form an inward bulge or "upset" 60 of material. At this point, the forward force of the stem 36 has squeezed the billet 54. The billet is thereby reduced slightly in length and the corresponding volume of the billet is diverted to the gap between the liner 14 and the billet 54 and to the gap between the mandrel and the billet to form the "upset" 60. The location of the intersection between the reduced diameter middle portion 50 of the mandrel and rearward portion 48 of the mandrel, relative to the inner die 20, determines the length of the preliminary forward or "pin" section 62 of the pipe, as shown in FIG. 7.

Figure 7:
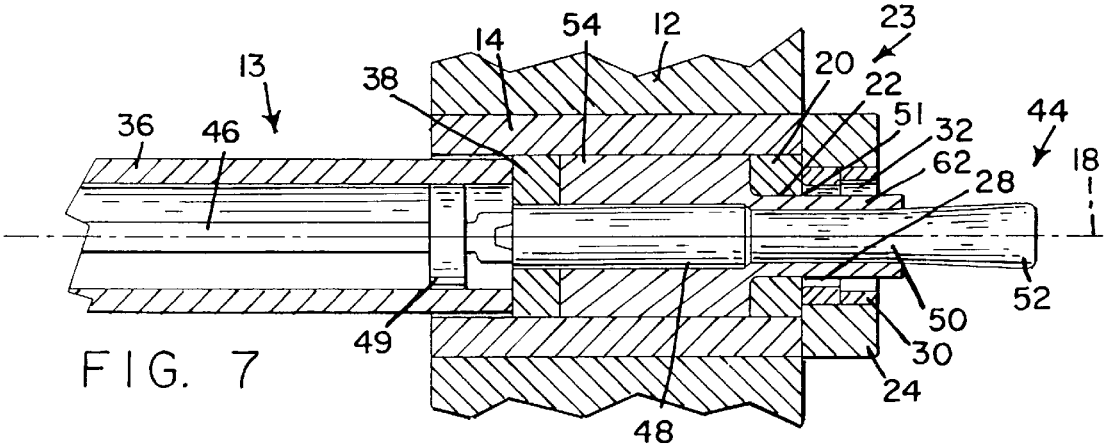
Figure 8:
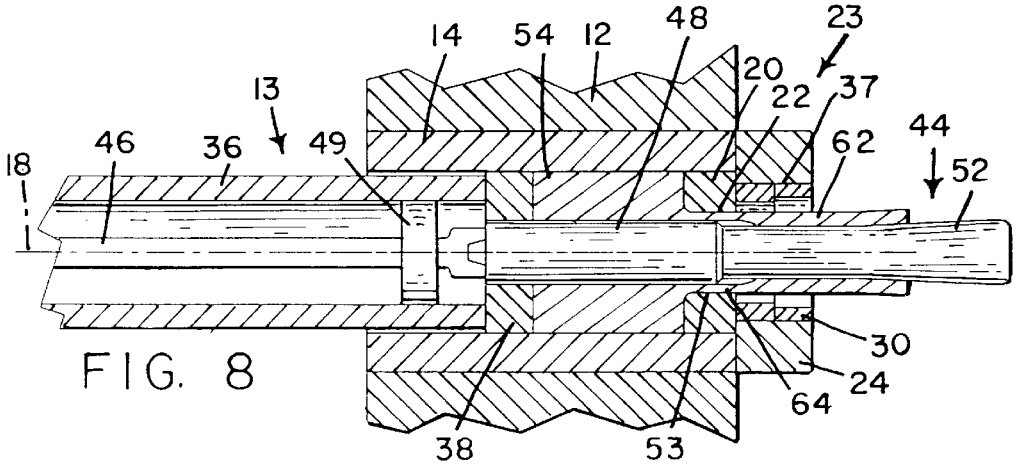

Continuous squeezing of the billet 54 by the forward movement of stem 36 for a first distance forces metal from the billet through a first ring-shaped opening or gap 51 between the inner surface of the inner die 20 and the reduced diameter middle portion 50 of the mandrel to form the cylindrical preliminary forward end section 62 of the pipe, as shown in FIG. 7. Preliminary forward end section 62 will eventually become the "pin" or forward end section of the pipe. The middle section 64 and the forward section 67 of the pipe are formed by moving the press 13 forwardly for a second distance. At this point, the cylindrical large diameter rear portion 48 of the mandrel reaches the rearward portion of the inner die 20. When the rearward portion 48 of the mandrel enters the bore 22 of the inner die 20, as shown in FIG. 8, a second ring shaped opening 53 is formed between the inner surface of the inner die 20 and the rearward portion 50 of the mandrel. The inner diameter of the second ring-shaped opening 53 is greater than the inner diameter of the first opening 51. This also means that the second ring-shaped opening 53 is narrower than the first ring shaped opening 51. Metal from billet 54 is, therefore, forced through the opening or gap 53 by the forward pressure of the stem 36 as a tubular extrusion having a thinner wall thickness. This begins the formation of a cylindrical middle section 64 of the pipe. At the same time, the preliminary forward end section 62 of the pipe reaches the tapered forward portion 52 of the mandrel, as shown in FIG. 8, and begins to expand transversely of the axis 18. Since the cross section of the billet 54 is much larger than the cross section of the finished pipe, the extruded pipe is several times longer than the billet. The length of the extruded pipe is determined by the ratio of the cross sectional area of the billet to the cross sectional area of the pipe (or extrusion ratio). For example, for an extrusion ratio of 12 to 1, for every inch that the press 13 advances, 12 inches of extruded pipe will be formed. This elongation at the point of extrusion causes the extruded pipe to slide over the outside diameter of the mandrel 44, since the mandrel is maintained in a fixed relationship to the housing or stem 36.

Figure 9:
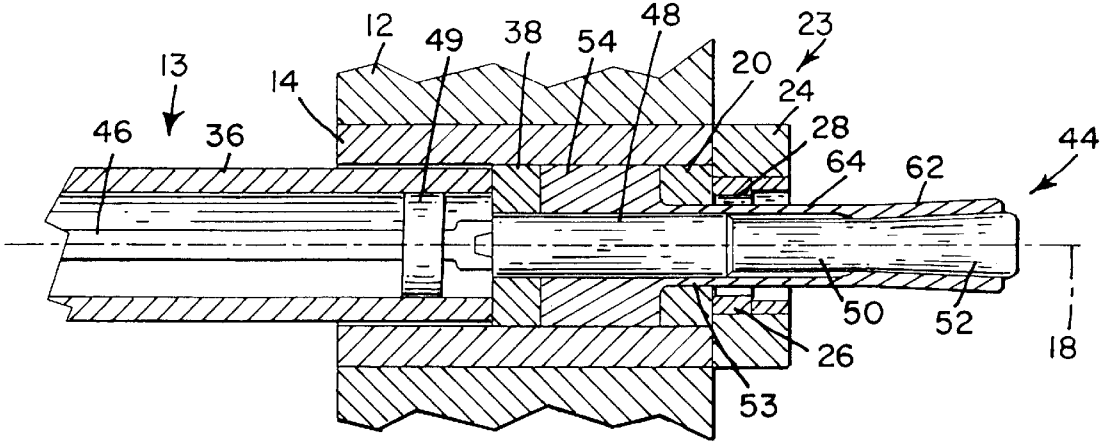

FIG. 9 shows further squeezing of the billet 54 and the lengthening of the middle section 64 of the pipe and continued flaring of the preliminary forward end section 62 of the pipe as it is forced over the tapered forward end portion 52 of the mandrel 44.

Figure 10:
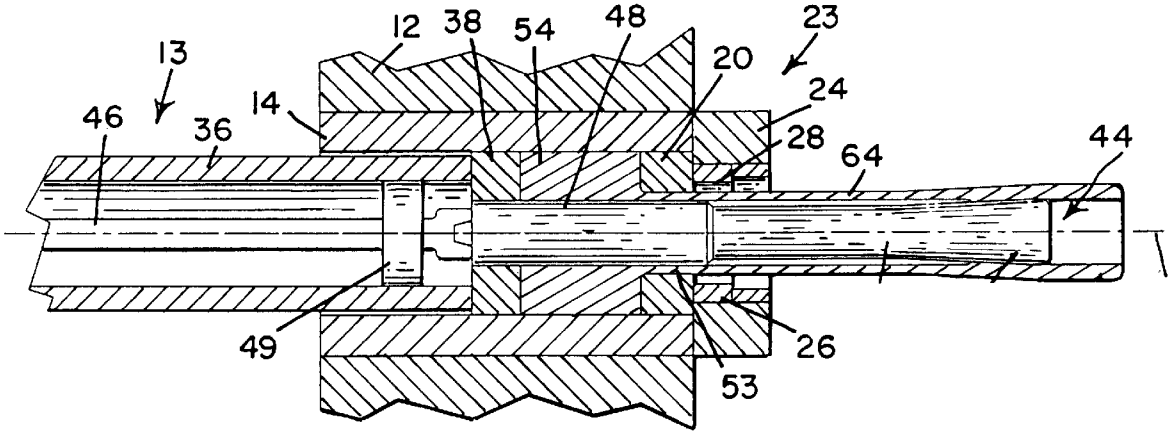
Figure 11:
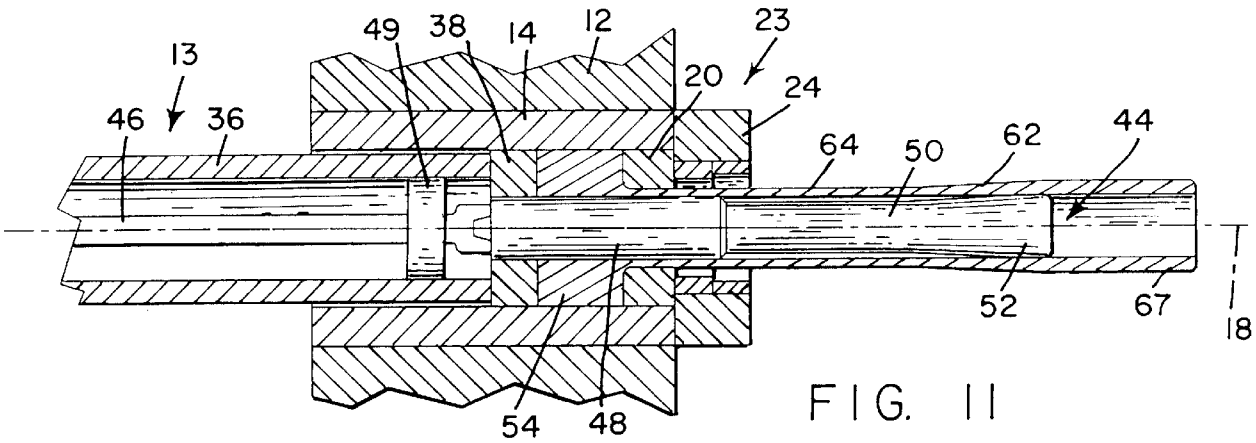

FIGS. 10 and 11 show the completion of the expansion process for the forward end section of the pipe. As the forward end of the preliminary forward end section 62 of the pipe passes the forward end of the tapered forward portion 52 of the mandrel, it becomes cylindrical, as shown in FIG. 10. Also, the inside diameter of the expanded forward end section 62 is the same as the inside diameter of the middle section 64. The preliminary forward end section 62 of the pipe is shown fully expanded in FIG. 11, thereby completing the formation of the forward, or "pin", end section of the pipe and is identified by the reference numeral 67.

Figure 12:
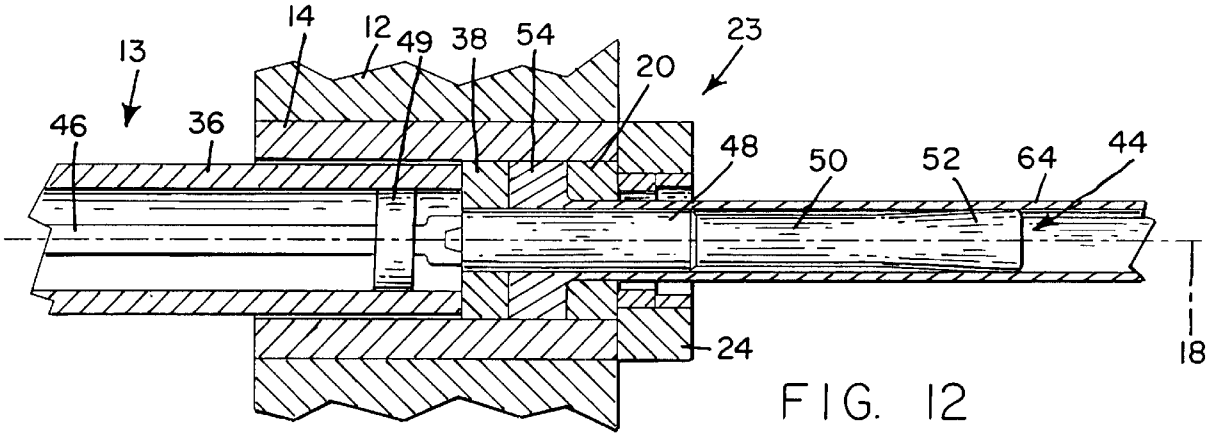
Figure 13:
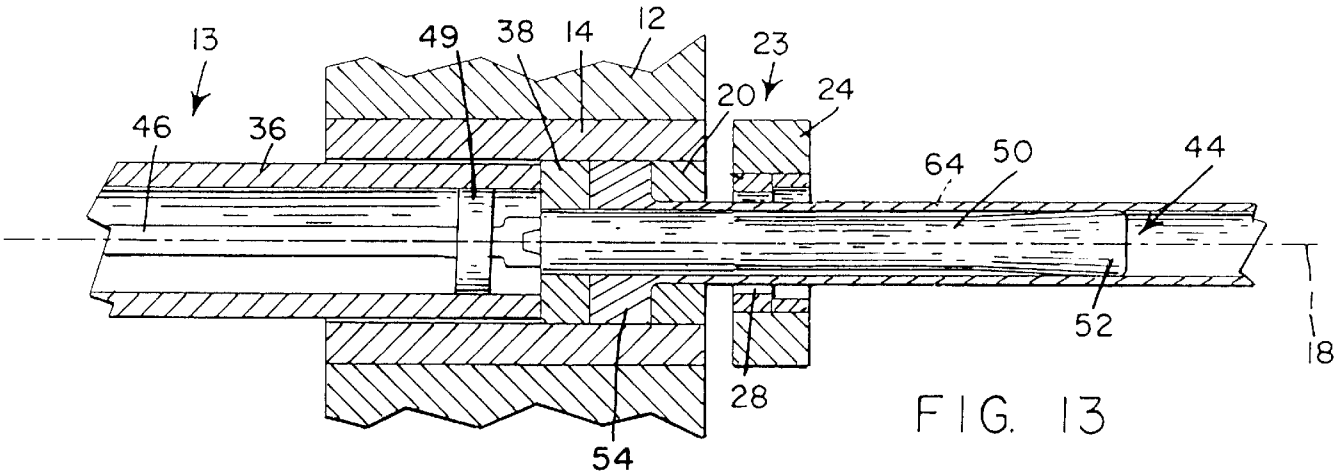
FIGS. 13–18 are operational views showing the formation of the rearward section of the pipe.
Figure 14:
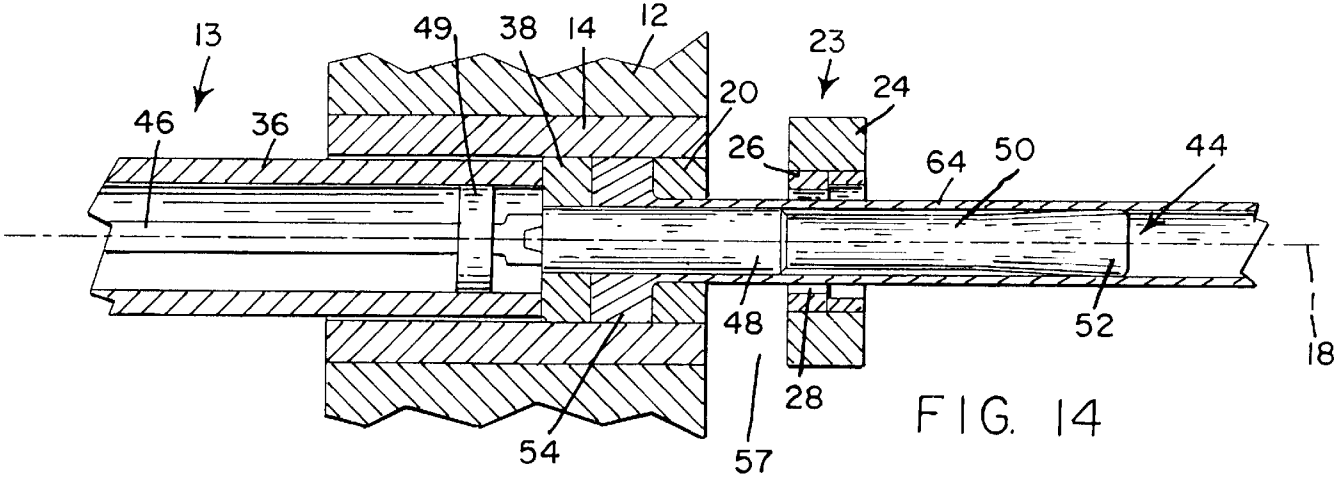
Figure 15:
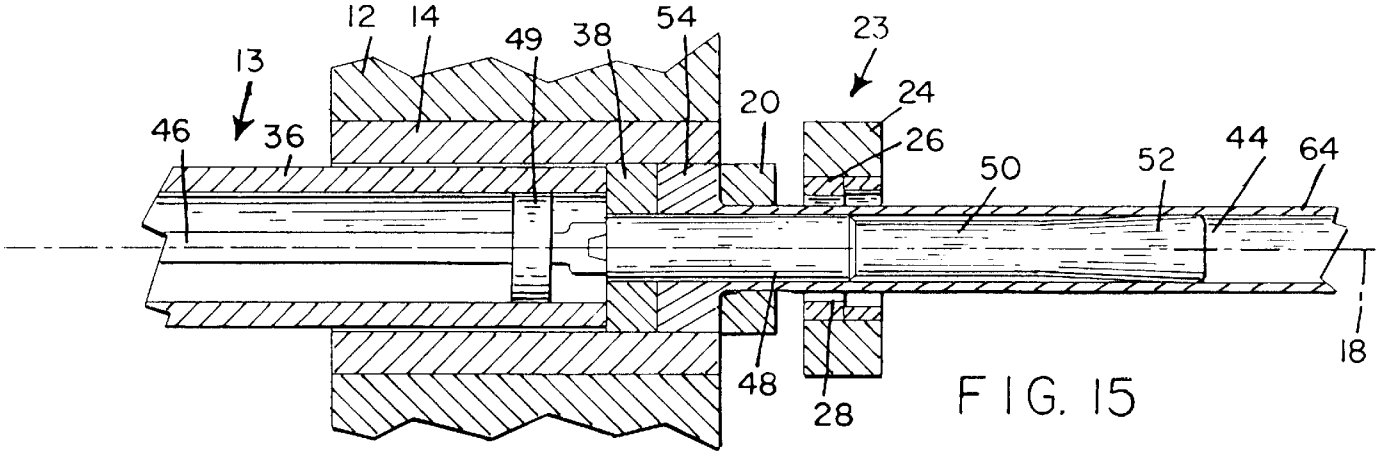
Figure 16:
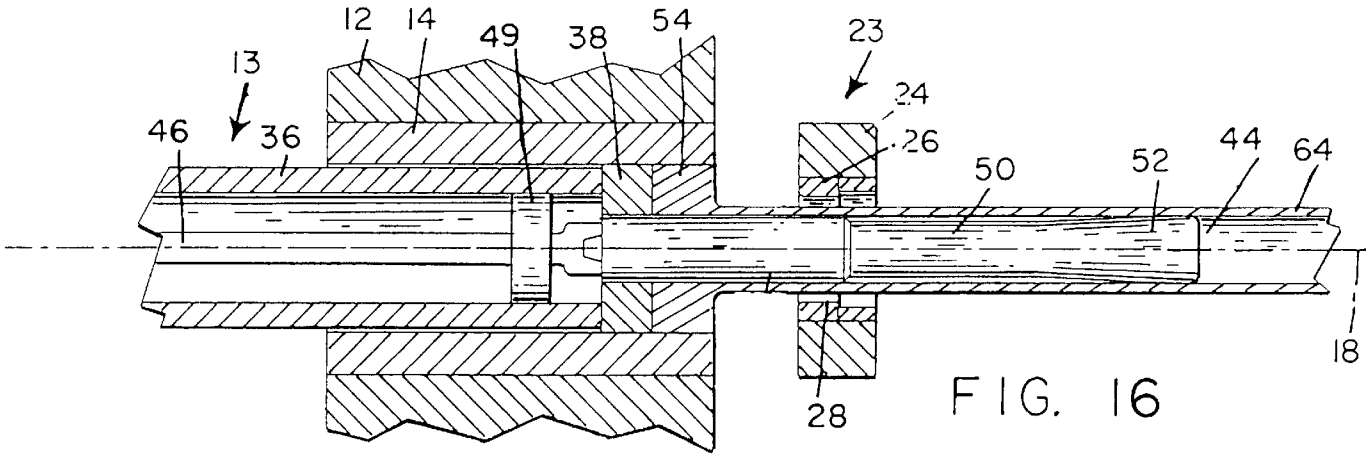
Figure 17:
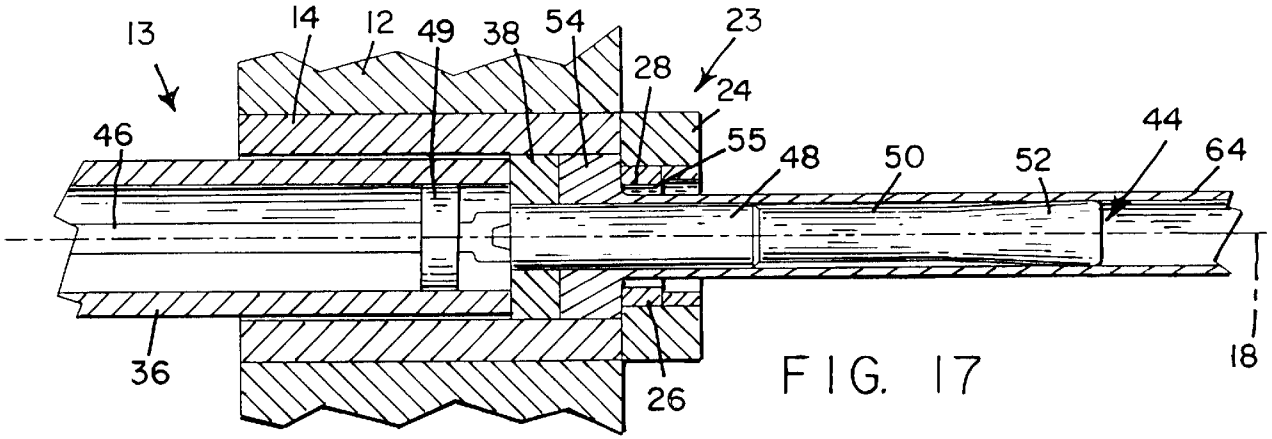

As the stem 36 continues to advance forwardly, the length of the middle section 64 of the pipe gradually lengthens until the required length of pipe has been extruded as shown in FIG. 12. After the middle section 64 of the pipe has been formed, the cylinder 77 is deactivated and the cylinders 81 and 85 are activated simultaneously to move the stem 36 and the container 12 rearwardly. The billet 54 and the partially extruded pipe also move rearwardly with the container 12, as shown in FIG. 13. This creates a small gap between the container 12 and the die holder 24 and eliminates the forward pressure on the die carrier 98. The cylinders 110 are then actuated to remove gates 104 from the chamber 100 and the removable die carrier 98 is moved forwardly to create a gap 57 between the die holder 24 and the container 12, as shown in FIG. 14. Gap 57 is wider than the inner 20. The cylinder 81 is deactivated and the cylinder 77 is again activated to move the stem 36 forwardly. This forces the inner die forwardly out of the container 12 and into the space 57, as shown in FIG. 15. When the inner die 20 clears the front opening 17 of the bore 16, the two halves of the inner die 20 separate and fall away from the middle section 64 of the pipe, as shown in FIG. 16. The housing 98 is moved rearwardly and the stem 36 and container 12 are moved forwardly to the rear opening 103 of the chamber 100 so that the die holder 24 abuts the forward surface of the container 12, as shown in FIG. 17. The cylinders 110 are actuated to return to the gates 104 to the chamber 100 in front of the die carrier 98.

The remaining portion of the billet 54 is used to form the rearward or "box" section of the pipe.

Figure 18:
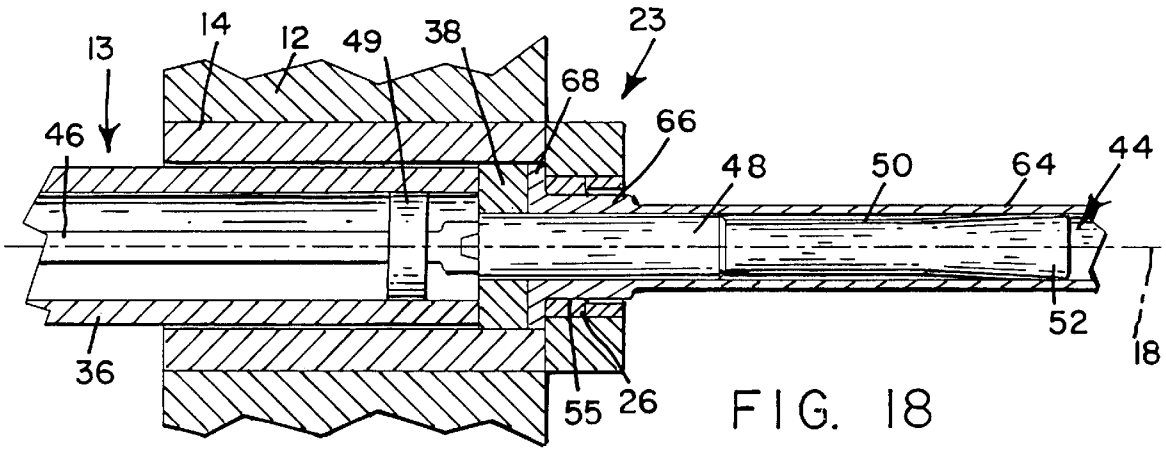

The cylinder 77 is actuated to move the press 13 and the stem 36 forwardly a third distance. The space between the rearward portion 48 of the mandrel and the inner surface of the bore 28 defines a third ring-shaped opening or gap 55. Forward movement of the press 13 for the third distance forces metal from the billet 54 through the third ring-shaped opening or gap 55. The bore 28 of the outer die 26 has a larger diameter than the bore 22 of the inner die 20 so that the thickness of the ring-shaped opening or gap 55 is greater than the thickness of the second ring-shaped opening or gap 53. Therefore, the metal from the billet 54 which is forced through the third opening 55 forms the relatively thicker rearward end section 66 of the pipe, as shown in FIG. 18. The outer diameter of the rearward end section 66 is substantially greater than the outer diameter of the middle section 64 of the pipe. At this point, the extrusion of the pipe is complete. A small unextruded portion of the billet 54 remains after the full desired length of the pipe has been extruded. The unextruded portion is identified by the reference numeral 68 in FIG. 18. The unextruded portion 68 can be removed from the pipe at the extruder by actuating the cylinder 69 to move the mandrel rearwardly out of the extruded pipe and by actuating the cylinder 88 to move the container 12 rearwardly. The rearward movement of the container 12 pushes the unextruded portion 68 of the billet out of bore 16 where it can be sawed from the end of the pipe. Preferably, the extruded pipe, including the unextruded portion 68 is moved a short distance rearward to facilitate removal of the unextruded portion 68. The extruded pipe is removed by actuating the cylinders 110 to move the gates 104 to their inactive positions out of the chamber 100. The die housing 98 is removed from the chamber 100 through the front opening 99. This enables the extruded pipe to be moved from the chamber 100 through the front opening 99. The unextruded portion 68 can be removed from the rearward end of the extruded pipe by any desired means, i.e., shearing, sawing, grinding, torching, laser cutting, etc. The extruded pipe is then removed from the chamber 100. The extruded pipe is a blank pipe form for subsequent finishing. The ends of the pipe are threaded and machined in a conventional manner to form a finished pipe.

Figure 20:
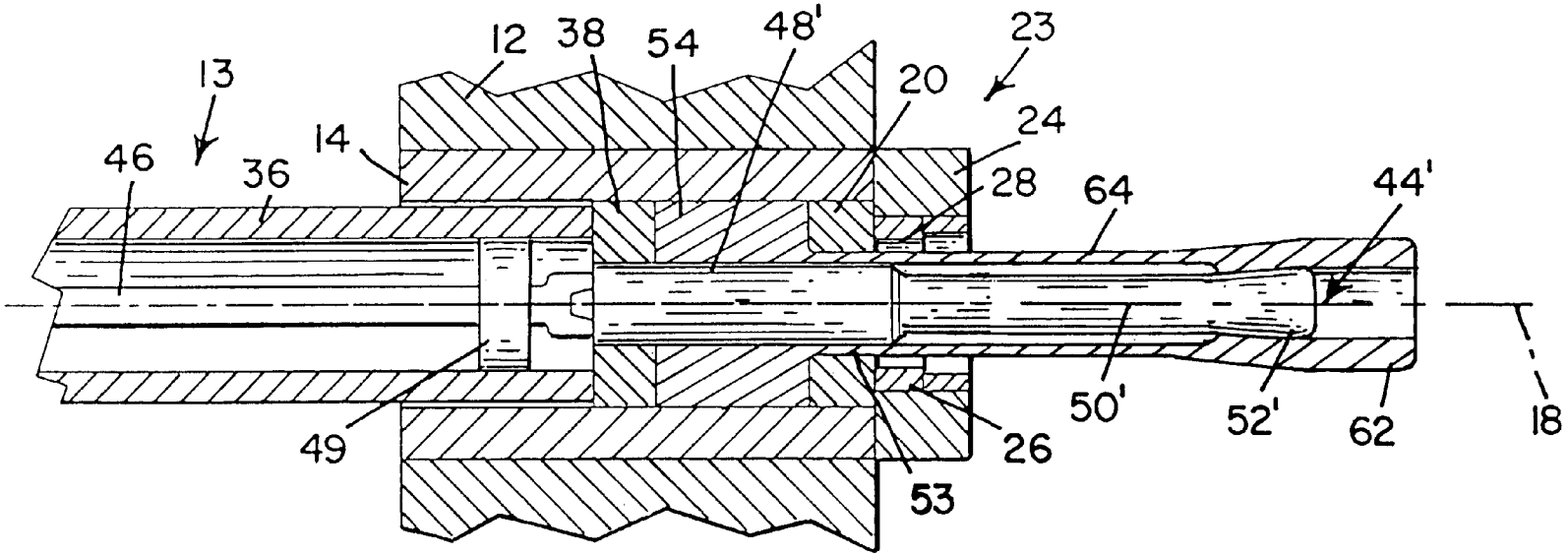
FIG. 20 is a view similar to FIG. 10 and showing a modified mandrel.

Referring to FIG. 20, a modified mandrel, generally indicated by the reference numeral 44', is shown within the container 12 at the expansion step of the forward end section of the pipe. The mandrel 44' has a cylindrical rearward portion 48', a reduced diameter cylindrical portion 50' and a frusto conical portion 52' which tapers outwardly from the reduced diameter middle portion 50' to the forward end of the mandrel. The mandrel 44' is identical to the mandrel 44 with respect to the rearward and middle portions of the mandrel. However, the mandrel 44' differs from the mandrel 44 with respect to the frusto conical forward portion of the mandrel. The outer diameter of the extreme forward end of the mandrel 44' is greater than the outer diameter of the middle portion 50' and less than the outer diameter of the rearward portion 48'. As the forward end of the preliminary forward end section 62 of the pipe passes the forward end of the tapered portion 52' of the mandrel 44', section 62 becomes cylindrical, as shown in FIG. 20. However, the inside diameter of the expanded forward end section 62 is less than the inside diameter of the middle section 64 of the pipe.

The invention having been thus described, what is claimed as new and desired to secure by Letters Patent is:

What is claimed:

1. An apparatus for extruding a metal pipe having a substantially uniform inner diameter, said pipe having a forward end section, a rearward end section and a middle section having an outer diameter which is substantially smaller than the outer diameter of each of said forward and rearward sections, said apparatus comprising:

(a) a machine frame;

(b) a container supported on the machine frame, said container having a central longitudinal axis and a longitudinal cylindrical first bore coaxial with said central longitudinal axis for receiving a cylindrical metal billet having a longitudinal cylindrical bore, said container having a front opening to said first bore and a rear opening to said first bore;

(c) a cylindrical inner die having a cylindrical second bore coaxial with said first bore, said inner die having an outer diameter equal to the diameter of said first bore, said second bore having a diameter which is smaller than the diameter of said first bore, said inner die being divided longitudinally into two substantially equal half portions, said inner die being movable through said front opening along said central longitudinal axis between an inner position within said first bore adjacent said front opening to an outer position outside of said first bore;

(d) an outer die assembly located forward of said container and having a longitudinal cylindrical third bore which is coaxial with said first and second bores and which has a larger diameter than said second bore, one of said outer die assembly and said container being movable along said central longitudinal axis between an active position wherein said container and said outer die assembly abut at said front opening and an inactive position wherein said outer die assembly and said container are spaced sufficiently to enable said inner die to be moved to said outer position for removal from said apparatus;

(e) a press located rearward of said container and movable along said central longitudinal axis toward and away from said container, said press having a circular forward pressing surface facing the rear opening of said container and a mandrel extending forwardly from said pressing surface toward said rear opening, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical rearward portion which has a smaller outer diameter than the inner diameter of said second bore, a cylindrical middle portion which has a smaller outer diameter than the outer diameter of said rearward portion, and a frustoconical forward portion which extends forwardly from said middle portion from an outer diameter equal to the outer diameter of said middle portion to an outer diameter substantially equal to the outer diameter of said rearward portion; and (f) an actuator for moving one of said outer die assembly and said container along said longitudinal axis relative to the other of said outer die assembly and said container.

2. An apparatus as recited in claim 1, wherein the longitudinal length of each section of said mandrel, relative to the longitudinal length of said inner die and a specific billet length being such that said middle portion is within said second bore when said billet is pushed forwardly into engagement with said inner die by said press and said press is pushed forwardly along said central longitudinal axis a first distance to a point that said rearward portion is at the rearward end of said second bore for forcing metal from said billet through said second bore around said middle portion for extruding a preliminary forward end section of said pipe having an outside diameter which is equal to the diameter of said second bore and an inside diameter which is equal to the diameter of said middle portion, the forward movement of said press along said central longitudinal axis for a second distance, while said rearward portion is within said second bore, causing metal from said billet to be forced through said second bore around the rearward portion of said mandrel to extrude the middle section of said pipe having an outer diameter which is equal to the inner diameter of said second bore and an inner diameter which is equal to the outer diameter of said rearward portion, the forward movement of said press for said second distance also causing the preliminary forward end section of said pipe to pass over the forward portion of said mandrel so that said preliminary forward end section is expanded transversely of said central longitudinal axis to form the forward end section of said pipe having an inner diameter which is equal to the outer diameter of the rearward portion of said mandrel and a thickness which is greater than the thickness of the middle section of said pipe, the forward movement of said press along said central longitudinal axis for a third distance, after removal of said inner die from said apparatus and while said outer die assembly in said active position, causing metal from said billet to be forced through said third bore around the rearward portion of said mandrel to extrude the rearward section of said pipe having an inner diameter which is equal to the outer diameter of said rearward portion and an outer diameter which is equal to the inner diameter of said third bore.

3. An apparatus as recited in claim 1, wherein said outer die assembly comprises:

(a) a die holder having a fourth bore, said die holder having a rearward end and a forward end;

(b) an outer die located in said fourth bore at the rearward end of said outer die holder and containing said third bore; and (c) a stop member located in said fourth bore at the forward end of said die holder, said stop member having a cylindrical fifth bore having a diameter which is larger than the diameter of said fourth bore.

4. An apparatus as recited in claim 1, wherein said mandrel has a rearward end and said press comprises:

(a) a housing having a chamber for containing said mandrel and a forward end having a opening to said chamber;

(b) a pressing ring located at the forward end of said housing at said forward opening, said pressing ring including said forward pressing surface and a cylindrical bore having an inner diameter which is substantially equal to the outer diameter of the rearward portion of said mandrel; and (c) a driver operatively connected to the rearward end of said mandrel for moving said mandrel along said central longitudinal axis between a rearward withdrawn position in which said rearward portion is within said chamber and a forward extended position in which the rearward portion of said mandrel in within the bore of said pressing ring and the remainder of said mandrel is forward of said pressing ring.

5. An apparatus as recited in claim 1, wherein said apparatus further comprises an actuator for moving said one of said outer die assembly and said container along said central longitudinal axis relative to the other of said outer die assembly and said container.

6. An apparatus as recited in claim 5, wherein said actuator is a fluid actuator comprising:

(a) a cylinder fixed to said machine frame; and (b) a piston slidable within said cylinder and having a rearward end extending rearwardly of said cylinder and operatively connected to said container.

7. An apparatus as recited in claim 6, wherein there is a first one of said fluid actuator on one side of said central longitudinal axis and a second one of said fluid actuator at an opposite side of said central longitudinal axis and said container is fixed to the pistons of said first and second fluid actuators.

8. An apparatus as recited in claim 1, wherein said outer die assembly comprises:

(a) a carrier having a central bore coaxial with said central longitudinal axis, said central bore having a forward opening and a rearward opening;

(b) a die holder within said central bore at the forward opening of said central bore, said die holder having a cylindrical fourth bore, a rearward end and a forward end; and (c) an outer die located in said fourth bore at the rearward end of said outer die assembly and containing said third bore; and a stop member located in said fourth bore at the forward end of said holder, said stop member having a cylindrical fifth bore having a diameter which is larger than the diameter of said fourth bore.

9. An apparatus as recited in claim 8, wherein said outer die assembly further comprises a retaining ring in said central bore and surrounding said die holder.

10. An apparatus as recited in claim 9, wherein said outer die assembly further comprises a retaining plate within said central bore and forward of said die holder, said retaining plate having a cylindrical bore which is coaxial with said central longitudinal axis and having a diameter which is larger than the diameter of said fifth bore and smaller than the diameter of said fourth bore.

11. An apparatus as recited in claim 10, wherein said outer die assembly further comprises a guide tube fixed to said retaining plate and extending forwardly through the forward opening of said central bore, said guide tube having an inner diameter is at least as large as the inner diameter of the bore of said retaining plate.

12. An apparatus as recited in claim 1, wherein said machine frame has a chamber which has a rear opening and a front opening, said outer die assembly being located within said chamber for longitudinal movement along said central longitudinal axis, said apparatus further comprising a releasable stop mechanism for releasably maintaining said outer die assembly within said chamber in functional contact with said inner die.

13. An apparatus as recited in claim 12, wherein said machine frame has a transverse bore extending transversely of said central longitudinal axis and intersecting said chamber, said releasable stop mechanism comprising a gate slidably mounted within said transverse bore between an active position in which at least a portion of said gate is within said chamber and an inactive position in which said gate is outside of said chamber.

14. An apparatus as recited in claim 13, wherein said releasable stop mechanism further comprises an actuator for selectively moving said gate to said active and inactive positions.

15. An apparatus as recited in claim 14, wherein said actuator is a fluid actuator.

16. An apparatus as recited in claim 1, wherein said apparatus further comprises a guide table forward of said outer die assembly for supporting and guiding said pipe as said pipe is extruded.

17. An apparatus as recited in claim 16, wherein said guide table has upwardly extending rollers for supporting said extruded pipe.

18. An apparatus as recited in claim 17, wherein said apparatus further comprises a guide tube extending from said outer die assembly to said guide table for guiding said extruded pipe from said outer die assembly to said guide table.

19. A mandrel for use in a metal extruding machine for extruding a metal pipe having a uniform inner diameter of a first dimension, a forward end section, a rearward end section, and a middle section between said forward and rearward end sections, said middle section having an outer diameter of a second dimension and each of said rearward and forward end sections having an outer diameter of which is greater than said second dimension, said mandrel comprising:

(a) a cylindrical rearward portion having an outer diameter equal to said first dimension;

(b) a cylindrical middle portion having an outer diameter substantially less than the outer diameter of said rearward portion; and (c) a forward portion which has a frusto-conical outer surface extending forwardly from said middle portion from an outer diameter equal to the outer diameter of said middle portion to an outer diameter equal to the outer diameter of said rearward portion.

20. A method of extruding a cylindrical metal pipe having a constant inner diameter, said pipe having a forward end section, a rearward end section and a middle section having an outer diameter which is substantially smaller than the outer diameter of each of said forward and rearward sections, said method comprising:

(a) positioning a cylindrical metal billet having a cylindrical longitudinal bore within a cylindrical first bore of a container by inserting said billet through a rear opening to said first bore, said first bore having a central longitudinal axis, said container having a front opening to said first bore and containing an inner die within said first bore adjacent said front opening and an outer die outside of said container adjacent said front opening, said inner die having a cylindrical second bore which has a smaller diameter than the diameter of said first bore, said outer die having a third bore which has a diameter which is less than the diameter of said first bore and greater than the diameter of said second bore, each of said inner and outer dies selectively being movable along said central longitudinal axis, said inner die comprising two separable half portions;

(b) positioning a press along said central longitudinal axis, said press having a circular forward pressing surface facing said container and a mandrel extending forwardly from said pressing surface toward said container, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical rearward portion which has a smaller diameter than said second bore, a cylindrical middle portion which has a smaller diameter than said rearward portion, and a frusto conical forward portion which extends forwardly from the diameter of said middle portion from a diameter equal to said middle portion to a diameter equal to the diameter of said rearward portion;

(c) moving said press forwardly along said central longitudinal axis so that said mandrel extends through the bore of said billet and said middle portion lies within said second bore to form a first ring-shaped opening and the juncture of said middle portion and said rearward portion is spaced rearward of said inner die when said forward pressing surface first engages said billet to push said billet against said inner die;

(d) moving said press forwardly a first distance along said central longitudinal axis to a point that the juncture of said middle portion and said rearward portion is at the rearward end of said second bore for forcing metal from said billet through said first ring-shaped opening to extrude a preliminary forward end section of pipe having an outer diameter which is equal to the inner diameter of said second bore and an inner diameter which is equal to the outer diameter of said middle portion;

(e) moving said press forwardly along said central longitudinal axis a second distance with said rearward portion within said second bore to form a second ring-shaped opening for forcing metal from said billet through said second ring-shaped opening to extrude the middle section of said pipe having an outer diameter which is equal to the inner diameter of said second bore and an inner diameter which is equal to the diameter of said rearward portion and causing the preliminary forward end section of pipe to pass over the forward portion of said mandrel during forward movement of said press for said second distance so that the preliminary forward end section of said pipe is expanded transversely of said central longitudinal axis to an inner diameter which is equal to the inner diameter of the middle section of said pipe and an outer diameter which is greater than the outer diameter of the middle section of said pipe;

(f) moving one of said outer die and said container along said central longitudinal axis so that said outer die is spaced from said stationary container a distance at least equal to the longitudinal length of said inner die;

(g) removing said inner die from said first bore through said front opening so that said inner die is forward of said container;

(h) removing the half portions of said inner die from said pipe and mandrel;

(i) moving one of said outer die and said container rearwardly along said central longitudinal axis so that said outer die is in engagement with said container and said rearward is within said third circular bore to form a third ring-shaped opening;

(j) moving said press forwardly along said central longitudinal axis for a third distance for forcing metal from said billet through said third ring-shaped opening to extrude the rearward section of said pipe having an inner diameter which is equal to the outer diameter of said rearward portion and an outer diameter which is equal to the inner diameter of said third bore; and (k) removing said extruded pipe from said mandrel.

21. A method of extruding a metal pipe as recited in claim 20, wherein said extruded pipe is removed from said mandrel by moving said mandrel rearwardly along said central longitudinal axis until said mandrel is rearward of said extruded pipe.

22. A method of extruding a metal pipe as recited in claim 20, wherein said container is moved rearwardly along said central longitudinal axis relative to said outer die and said mandrel at step (f) of claim 20 for forcing said inner die out of said first bore.

23. A method of extruding a metal pipe as recited in claim 20, wherein an unextruded portion of said billet remains within said first bore after the forward movement of said mandrel for said third distance and said method comprises the following additional steps:

(a) moving said mandrel rearwardly along said central longitudinal axis until said mandrel is rearward of said extruded pipe;

(b) moving one of said outer die and said container forwardly along said central longitudinal axis so that said outer die is spaced from said container; and (c) removing the unextruded portion of said billet from the rearward end section of said extruded pipe.

24. A method of extruding a metal pipe as recited in claim 23, wherein said container is moved rearwardly along said central longitudinal axis relative to said outer die and said mandrel at step (b) of claim 23 for forcing the unextruded portion of said billet from said first bore.

25. A method of extruding a cylindrical metal pipe having a uniform inner diameter of a first dimension, a forward end section, a rearward end section, and a middle section between said forward and rearward end sections, said middle section having an outer diameter of a second dimension and each of said rearward and forward end sections having an outer diameter which is greater than said second dimension, said method comprising the following steps:

(a) pressing a cylindrical metal billet within a cylindrical bore of a container through a first ring shaped opening having an inner diameter which is less than said first dimension and an outer diameter which is equal to said second dimension to extrude a preliminary forward end section of said pipe having an inner diameter which is less than said first dimension;

(b) pressing said metal billet within said bore through a second ring shaped opening having an inner diameter which is equal to said first dimension and an outer diameter which is equal to said second dimension to extrude the middle section of said pipe;

(c) moving said preliminary forward end section of pipe over a mandrel which has a frusto-conical outer surface shaped for expanding the preliminary forward end section of said pipe to form the forward end section of said pipe having an inner diameter equal to said first dimension and an outer diameter which is greater than said second dimension; and (d) pressing said metal billet within said bore through a third ring shaped opening having an inner diameter which is equal to said first dimension and an outer diameter which is greater than said third dimension to extrude the rearward end section of said pipe.

26. An apparatus for extruding a metal pipe having a forward end section, a rearward end section and a middle section having an outer diameter which is substantially smaller than the outer diameter of each of said forward and rearward sections, said forward end section having an inner diameter which is smaller than the inner diameter of each of said rearward end section and said middle section, said apparatus comprising:

(a) a machine frame;

(b) a container supported on the machine frame, said container having a central longitudinal axis and a longitudinal cylindrical first bore coaxial with said central longitudinal axis for receiving a cylindrical metal billet having a longitudinal cylindrical bore, said container having a front opening to said first bore and a rear opening to said first bore;

(c) a cylindrical inner die having a cylindrical second bore coaxial with said first bore, said inner die having an outer diameter equal to the diameter of said first bore, said second bore having a diameter which is smaller than the diameter of said first bore, said inner die being divided longitudinally into two substantially equal half portions, said inner die being movable through said front opening along said central longitudinal axis between an inner position within said first bore adjacent said front opening to an outer position outside of said first bore;

(d) an outer die assembly located forward of said container and having a longitudinal cylindrical third bore which is coaxial with said first and second bores and which has a larger diameter than said second bore, one of said outer die assembly and said container being movable along said central longitudinal axis between an active position wherein said container and said outer die assembly abut at said front opening and an inactive position wherein said outer die assembly and said container are spaced sufficiently to enable said inner die to be moved to said outer position for removal from said apparatus;

(e) a press located rearward of said container and movable along said central longitudinal axis toward and away from said container, said press having a circular forward pressing surface facing the rear opening of said container and a mandrel extending forwardly from said pressing surface toward said rear opening, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical rearward portion which has a smaller outer diameter than the inner diameter of said second bore, a cylindrical middle portion which has a smaller outer diameter than the outer diameter of said rearward portion, and a frusto-conical forward portion which extends forwardly from said middle portion from an outer diameter equal to the outer diameter of said middle portion to an outer diameter larger than the outer diameter of said middle portion and smaller than the outer diameter of said rearward portion; and (f) an actuator for moving one of said outer die assembly and said container along said longitudinal axis relative to the other of said outer die assembly and said container.

27. A mandrel for use in a metal extruding machine for extruding a metal pipe having a uniform inner diameter of a first dimension, a forward end section, a rearward end section, and a middle section between said forward and rearward end sections, said middle section having an inner diameter of a first dimension and an outer diameter of a second dimension, each of said rearward and forward end sections having an outer diameter which is greater than said second dimension, said forward section having an inner diameter which is less than said first dimension, said mandrel comprising:

(a) a cylindrical rearward portion having an outer diameter equal to said first dimension;

(b) a cylindrical middle portion having an outer diameter substantially less than the outer diameter of said rearward portion; and (c) a forward portion which has a frusto-conical outer surface extending forwardly from said middle portion from an outer diameter equal to the outer diameter of said middle portion to an outer diameter which is less than said first dimension and greater than the outer diameter of said middle portion.

28. A method of extruding a cylindrical metal pipe having a forward end section, a rearward end section and a middle section having an outer diameter which is substantially smaller than the outer diameter of each of said forward and rearward sections, said forward end section having an inner diameter which is smaller than the inner diameter of each of said rearward end section and said middle section, said method comprising:

(a) positioning a cylindrical metal billet having a cylindrical longitudinal bore within a cylindrical first bore of a container by inserting said billet through a rear opening to said first bore, said first bore having a central longitudinal axis, said container having a front opening to said first bore and containing an inner die within said first bore adjacent said front opening and an outer die outside of said container adjacent said front opening, said inner die having a cylindrical second bore which has a smaller diameter than the diameter of said first bore, said outer die having a third bore which has a diameter which is less than the diameter of said first bore and greater than the diameter of said second bore, each of said inner and outer dies selectively being movable along said central longitudinal axis, said inner die comprising two separable half portions;

(b) positioning a press along said central longitudinal axis, said press having a circular forward pressing surface facing said container and a mandrel extending forwardly from said pressing surface toward said container, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical rearward portion which has a smaller outer diameter than the inner diameter of said second bore, a cylindrical middle portion which has a smaller diameter than said rearward portion, and a frusto conical forward portion which extends forwardly from said middle portion from an outer diameter equal to the outer diameter of said middle portion to a diameter which is larger than the outer diameter of said middle portion and smaller than the diameter of said rearward portion;

(c) moving said press forwardly along said central longitudinal axis so that said mandrel extends through the bore of said billet and said middle portion lies within said second bore to form a first ring-shaped opening and the juncture of said middle portion and said rearward portion is spaced rearward of said inner die when said forward pressing surface first engages said billet to push said billet against said inner die;

(d) moving said press forwardly a first distance along said central longitudinal axis to a point that the juncture of said middle portion and said rearward portion is at the rearward end of said second bore for forcing metal from said billet through said first ring-shaped opening to extrude a preliminary forward end section of pipe having an outer diameter which is equal to the inner diameter of said second bore and an inner diameter which is equal to the outer diameter of said middle portion;

(e) moving said press forwardly along said central longitudinal axis a second distance with said rearward portion within said second bore to form a second ring-shaped opening for forcing metal from said billet through said second ring-shaped opening to extrude the middle section of said pipe having an outer diameter which is equal to the inner diameter of said second bore and an inner diameter which is equal to the diameter of said rearward portion and causing the preliminary forward end section of pipe to pass over the forward portion of said mandrel during forward movement of said press for said second distance so that the preliminary forward end section of said pipe is expanded transversely of said central longitudinal axis to an inner diameter which is less than the inner diameter of the middle section of said pipe and an outer diameter which is greater than the outer diameter of the middle section of said pipe;

(f) moving one of said outer die and said container along said central longitudinal axis so that said outer die is spaced from said stationary container a distance at least equal to the longitudinal length of said inner die;

(g) removing said inner die from said first bore through said front opening so that said inner die is forward of said container;

(h) removing the half portions of said inner die from said pipe and mandrel;

(i) moving one of said outer die and said container rearwardly along said central longitudinal axis so that said outer die is in engagement with said container and said rearward is within said third circular bore to form a third ring-shaped opening;

(j) moving said press forwardly along said central longitudinal axis for a third distance for forcing metal from said billet through said third ring-shaped opening to extrude the rearward section of said pipe having an inner diameter which is equal to the outer diameter of said rearward portion and an outer diameter which is equal to the inner diameter of said third bore; and (k) removing said extruded pipe from said mandrel.

29. A method of extruding a metal pipe as recited in claim 28, wherein said extruded pipe is removed from said mandrel by moving said mandrel rearwardly along said central longitudinal axis until said mandrel is rearward of said extruded pipe.

30. A method of extruding a metal pipe as recited in claim 28, wherein said container is moved rearwardly along said central longitudinal axis relative to said outer die and said mandrel at step (f) of claim 20 for forcing said inner die out of said first bore.

31. A method of extruding a metal pipe as recited in claim 28, wherein an unextruded portion of said billet remains within said first bore after the forward movement of said mandrel for said third distance and said method comprises the following additional steps:

(a) moving said mandrel rearwardly along said central longitudinal axis until said mandrel is rearward of said extruded pipe;

(b) moving one of said outer die and said container forwardly along said central longitudinal axis so that said outer die is spaced from said container; and (c) removing the unextruded portion of said billet from the rearward end section of said extruded pipe.

32. A method of extruding a metal pipe as recited in claim 31, wherein said container is moved rearwardly along said central longitudinal axis relative to said outer die and said mandrel at step (b) of claim 23 for forcing the unextruded portion of said billet from said first bore.

33. A method of extruding a cylindrical metal pipe having a forward end section, a rearward end section, and a middle section between said forward and rearward end sections, said middle section having an inner diameter of a first dimension and an outer diameter of a second dimension, said rearward end section having an inner diameter of said first dimension and an outer diameter greater than said second dimension, said forward end section having an outer diameter which is greater than said second dimension and an inner diameter of a third dimension which is less than said first dimension, said method comprising the following steps:

(a) pressing a cylindrical metal billet within a cylindrical bore of a container through a first ring shaped opening having an inner diameter which is less than said third dimension and an outer diameter which is equal to said second dimension to extrude a preliminary forward end section of said pipe having an inner diameter which is less than said third dimension;

(b) pressing said metal billet within said bore through a second ring shaped opening having an inner diameter which is equal to said first dimension and an outer diameter which is equal to said second dimension to extrude the middle section of said pipe;

(c) moving said preliminary forward end section of pipe over a mandrel which has a frusto-conical outer surface shaped for expanding the preliminary forward end section of said pipe to form the forward end section of said pipe having an inner diameter equal to said third dimension and an outer diameter which is greater than said second dimension; and (d) pressing said metal billet within said bore through a third ring shaped opening having an inner diameter which is greater than said first dimension and an outer diameter which is greater than said second dimension to extrude the rearward end section of said pipe.

* * * * *